US005545059A

United States Patent [19]

Nelson

[11] Patent Number: 5,545,059

[45] Date of Patent: Aug. 13, 1996

[54] CONNECTOR FOR A HOLLOW CENTER CONDUCTOR OF A RADIO FREQUENCY CABLE

[75] Inventor: James W. Nelson, Cheshire, Conn.

[73] Assignee: Radio Frequency Systems, Inc., Marlboro, N.J.

[21] Appl. No.: 413,963

[22] Filed: Mar. 30, 1995

[51] Int. Cl.[6] ..... H01R 17/18

[52] U.S. Cl. ..... 439/583; 439/783; 439/784; 439/805; 439/807

[58] Field of Search ..... 439/578, 583, 439/783, 784, 805, 807

[56] References Cited

U.S. PATENT DOCUMENTS

| | | | |
|---|---|---|---|
| 1,438,454 | 12/1922 | Mitchell | 439/805 |
| 2,313,780 | 3/1943 | Snyder | 439/805 |
| 2,859,425 | 11/1958 | Felton | 439/807 |
| 3,291,895 | 12/1966 | Van Dyke | 174/88 |
| 3,813,468 | 5/1974 | Shaw | 439/805 |
| 4,496,208 | 1/1985 | Spinner et al. | 439/583 |
| 5,090,924 | 2/1992 | Pfaller et al. | 439/807 |
| 5,137,470 | 8/1992 | Doles | 439/578 |
| 5,167,533 | 12/1992 | Rauwolf | 439/583 |
| 5,474,478 | 12/1995 | Ballog | 439/805 |

FOREIGN PATENT DOCUMENTS

| | | | |
|---|---|---|---|
| 565811 | 11/1944 | United Kingdom | 439/805 |

*Primary Examiner*—Gary E. Elkins

*Attorney, Agent, or Firm*—Ware, Fressola, Van Der Sluys & Adolphson

[57] ABSTRACT

A hollow center conductor connector assembly having an expandable plug (12), a plug-expanding-conductor-coupler (14) and a bolt (15) provides a connector for smooth wall hollow center conductors and corrugated wall center conductors. The expandable plug (12) is provided with fine teeth (34) for gripping a smooth wall type center conductor and a helical groove (36) for gripping a corrugated wall type center conductor. The diameter of the expandable plug (12) is expanded when the plug-expanding-conductor-coupler (14) and expandable plug (12) are drawn together by a bolt (15).

12 Claims, 2 Drawing Sheets

CONNECTOR FOR A HOLLOW CENTER CONDUCTOR OF A RADIO FREQUENCY CABLE

BACKGROUND OF THE INVENTION

1. Field of the Invention

The present invention generally relates to cable connectors for connecting coaxial radio frequency cables together. More particularly, the present invention relates to a single connector assembly for a hollow center conductor of a coaxial radio frequency cable that can be attached to either a smooth wall type hollow center conductor or a corrugated wall type hollow center conductor.

1. Description of the Prior Art

Coaxial radio frequency (RF) cables having hollow center conductors are generally used for many applications including land mobile, microwave broadcast and radar band frequencies. Such cables typically comprise an outer conductor fabricated from copper, a copper hollow center conductor, a dielectric foam spaced between the outer and center conductors and a jacket over the outer conductor. The hollow center conductors can have a smooth wall or a corrugated wall.

Coaxial RF cables are typically terminated with a connector or connected to one and other with a splice. One example of such a connector is shown in Rauwolf, U.S. Pat. No. 5,167,533. The connector shown and described therein generally has several elements for attaching the connector to a cable. The attachment elements include a clamping member for grasping and making an electrical connection with the outer conductor of the cable, and a inner contact assembly for mating and making electrical contact with the center conductor.

Prior art hollow center conductor connectors or contacts are typically manufactured and designed exclusively for mating with either a hollow center conductor having the corrugated wall, as shown in Rauwolf, or a hollow center conductor having the smooth wall, but not both. Accordingly, because RF cables used in the industry may have either a corrugated wall or a smooth wall hollow center conductor, RF cable connector manufacturers, installers, maintenance personnel, and others dealing with RF cables of this type have had to manufacture, supply and carry in inventory two different types of hollow center conductor connectors. This drawback can lead to excess inventory, higher operating costs and lower profitability.

SUMMARY OF THE INVENTION

It is one object of the present invention to provide a single connector assembly that can be used with coaxial cables having smooth wall hollow center conductors and coaxial cables having corrugated wall hollow center conductors.

It is another object of the present invention to provide a single connector assembly with only a small number of parts.

Other objects and advantages of the invention will be apparent from the following detailed description and the accompanying drawings.

In accordance with the present invention, the foregoing objectives are realized by providing a hollow center conductor connector assembly having three principal components: an expandable plug, a plug-expanding-conductor-coupler and a bolt.

The expandable plug, the first component, has a body formed from cylindrical segments held together at a common end by a shoulder. The shoulder includes a threaded bore. The cylindrical segments include outer surfaces having fine teeth for gripping smooth wall center conductors and a helical groove forming a corrugation receiving recess. The teeth and groove on the outer surface of the cylindrical segments provide a surface for engaging with either a smooth wall or corrugated wall hollow center conductor. The cylindrical segments forming the body of the plug further include axial grooves that form bolt receiving recesses. The segments also include inwardly tapering surfaces at a second end for receiving a plug-expanding-surface located at one end of the plug-expanding-conductor-coupler.

The plug-expanding-conductor-coupler, the second component, provides the connector assembly of the present invention with a means for expanding the diameter of the expandable plug and with a coupling for connecting to another center conductor coupling assembly attached to the end of another cable. The plug-expanding-conductor-coupler has a plug-expanding-surface that tapers outwardly, either as a flat or conical shaped surface, from a first end and a hollow cylindrical coupling at a second end. The plug-expanding-conductor-coupler also includes an axial bore extending from the first end to a bolt head receiving shoulder within the hollow cylindrical coupling. The axial bore in the plug-expanding-conductor-coupler allows the bolt, the final component of the assembly, to be positioned within the plug-expanding-conductor-coupler for drawing the coupler and expandable plug together.

According to the present invention, the expandable plug may be expanded by drawing the plug-expanding-conductor-coupler and plug together with the bolt when the plug-expanding-surface of the coupler is positioned adjacent to the inwardly tapering surfaces at the second end of the plug. Expansion is accomplished by inserting the threaded end of the bolt through the axial bore of the coupler and down the axial grooves of the semi-cylindrical segments of the plug until it is threaded in the shoulder of the plug. Once threaded, the bolt may be tightened so that the bolt head provides a force on the bolt head receiving shoulder within the hollow cylindrical coupling end of the plug-expanding-conductor-coupler. The tightening of the bolt causes the coupler and plug to be drawn together wherein a wedging force is applied by the plug-expanding-surface on the coupler to the inwardly tapering surfaces at the second end of the plug thereby causing the plug's diametric expansion.

BRIEF DESCRIPTION OF THE DRAWINGS

The drawings, not drawn to scale, include.

DETAILED DESCRIPTION OF THE PRESENT INVENTION

Figures 1, 2, 3:
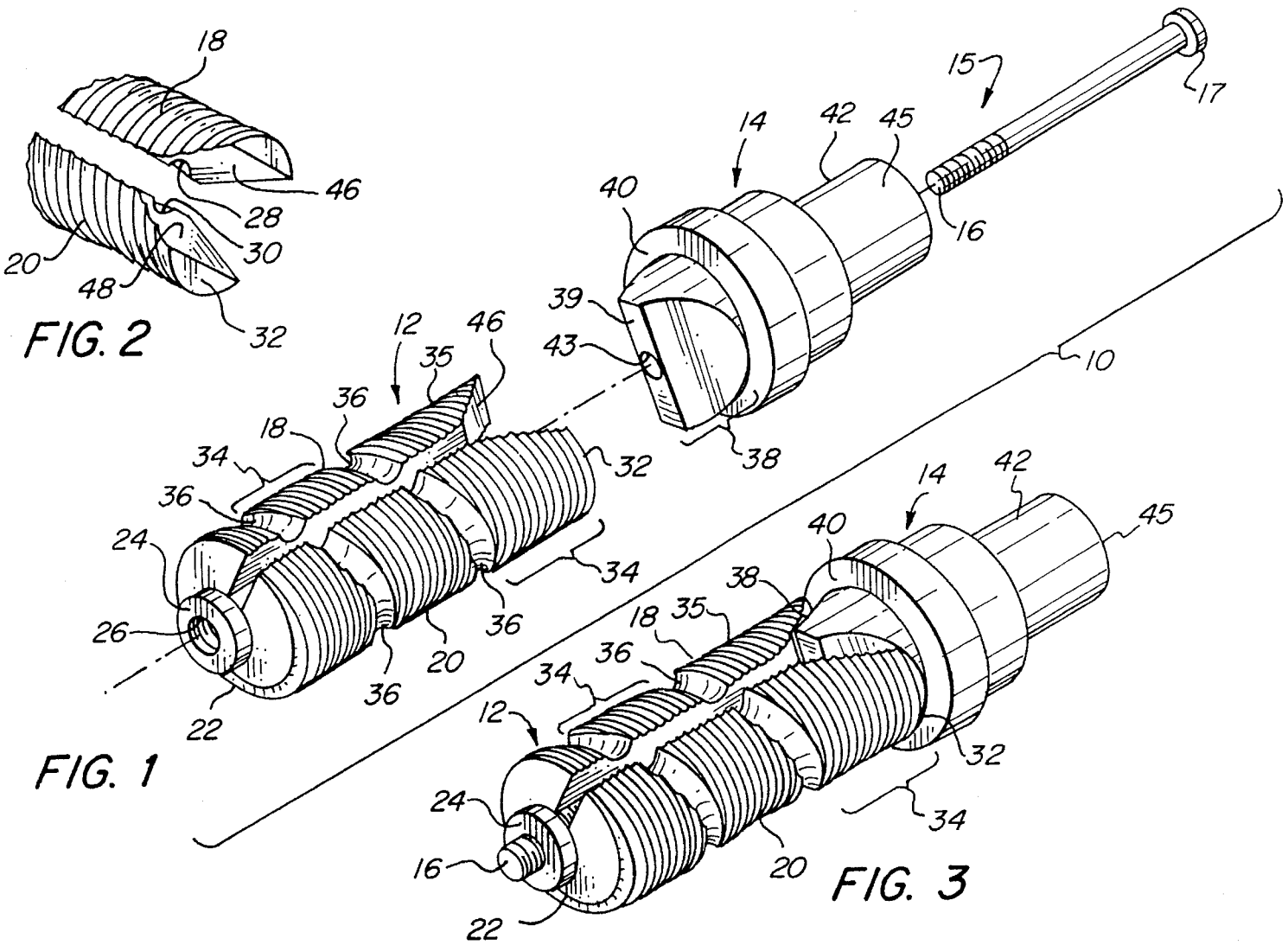
FIG. 1 which is an exploded perspective view of a coaxial cable center conductor connector embodying the present invention.
FIG. 2 which is a perspective view of the assembled connector of FIG. 1.
FIG. 3 which is a perspective view of one end of the plug.

As shown in the exploded perspective view of FIG. 1, the present invention is a center conductor connector assembly 10 that may be mated with a hollow center conductor of a coaxial radio frequency (RF) cable (not shown) of either the smooth wall type or the corrugated wall type. Generally, the connector assembly 10 of the present invention includes an expandable plug 12 for attaching the connector assembly 10 firmly to and within a hollow center conductor, a plug-expanding-conductor-coupler 14 for expanding the plug 12 and for providing a coupling to another center conductor connector, and a bolt 15, having a threaded end 16 and a head end 17, for drawing the coupler 14 and the plug 12 together.

The expandable plug 12 is formed by a plurality of partially cylindrical segments joined together at a common end. Referring to the illustrative embodiment shown in FIGS. 1 and 3, the plug 12 shown therein is constructed from two electrically conductive semi-cylindrical shaped halves 18 and 20 held together at the plug's 12 first end 22 by shoulder 24. A threaded axial bore 26 is provided in shoulder 24 for receiving the threaded end 16 of bolt 15. Axial grooves 28 and 30 are provided in each of the semi-cylindrical halves 18 and 20, respectively, from the first end 22 to a second end 32 to form a receiving recess for the shank of bolt 15.

A plurality of fine teeth or threads 34 are cut or turned into the cylindrical surface 35 of each of the semi-cylindrical halves 18 and 20 of the plug 12. These fine teeth or threads 34 provide the plug 12 with a means for gripping a smooth wall center conductor's inside surface when the plug 12 is finally positioned and expanded within a center conductor as shown in the cross-sectional view of FIG. 4.

In addition to the fine teeth 34, the exterior surface 35 of the semi-cylindrical halves 18 and 20 are provided with a helical groove 36. The helical groove 36, which helically wraps around both halves 18 and 20, has a pitch and depth substantially matching the pitch and crest height of the helical corrugation of a corrugated center conductor so as to form a helical corrugation receiving recess. The helical groove 36 enables the plug 12 to firmly engage with a corrugated center conductor 102, by allowing the corrugations 104 to reside in the matching groove 36 as shown in the cross-sectional view of FIG. 5. As with a smooth wall center conductor, the plug 12 is also expanded by the plug-expanding-conductor-coupling 14 as will be described below.

It should be appreciated by those skilled in the art that while the illustrative embodiment of the plug 12 shown herein comprises two semi-cylindrical shaped halves, there is no limit to the number of segments that may comprise the plug 12. Rather than two semi-cylindrical shaped halves, the plug 12 may be constructed, for example, from three, four or even five segments which may be of equal or unequal size. Whatever number of segments are chosen to construct the plug, it is important that the exterior surfaces of the segments, such as exterior surface 35 of the semi-cylindrical segments in the illustrative embodiment, have fine teeth and a helical groove so as to provide a surface which will firmly engage with smooth and corrugated wall conductors. The segments should also have axial grooves corresponding to the axial grooves 28 and 30 shown in the illustrative embodiment.

Referring back to illustrative embodiment of the present invention shown in FIG. 1, the plug-expanding-conductor-coupler 14 for expanding the plug 12 formed from two semi-cylindrical halves 18 and 20, generally includes a plug-expanding-surface 38 tapering outwardly from a first end 39 to a flange surface 40. The plug-expanding-conductor-coupler 14 also includes a hollow cylindrical coupling 42 extending from a second end 45 towards the flange surface 40. The plug-expanding-conductor-coupler 14 also includes an axial bore, with opening 43, extending from the first end 39 to a bolt head receiving shoulder 44 within the hollow cylindrical coupling 42.

As shown in FIG. 2, the second end 32 of plug 12 includes inwardly tapering surfaces 46 and 48. The taper of these surfaces is dimensioned to match the shape of the outwardly tapering plug-expanding-surface 38 of the coupler 14. If a greater number of cylindrical segments are used to form the expandable plug 12, each of the cylindrical segments should be provided with an inwardly tapering surface that is equivalent to surfaces 46 and 48 of the illustrative embodiment. Also, when the number of cylindrical segments used to form the expandable plug 12 is greater than the two shown in the illustrative embodiment of FIG. 1 or are not of equal size, those skilled in the art should now appreciate that the outwardly tapering plug-expanding-surface 38 of the coupler 14 should be modified to provide surfaces which will engage with each of the inwardly tapering surfaces of the cylindrical segments that are equivalent to the surfaces 46 and 48 at the second end 32 of the plug 12. For example, when three equal sized cylindrical segments are used to form the expandable plug 12, the plug-expanding-surface 38 should be modified so as to have three sides, similar to a tetrahedral, instead of two, like a wedge, to engage with the inwardly tapering surfaces of the cylindrical segments that are similar to the surfaces 46 and 48 of the illustrative embodiment of the plug 12. The matching shapes of the plug-expanding-surface 38 and inwardly tapering surfaces of the plug ensures good diametric expansion of the plug 12 when it is drawn together with the coupler 14.

Figure 6B:
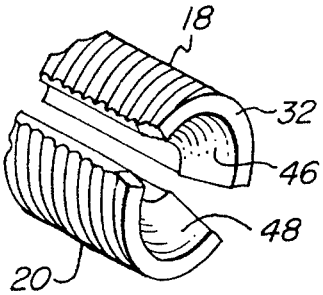
FIG. 6B, which is a perspective view of one end of an alternative embodiment of the expandable plug for receiving the alternative embodiment of the plug-expanding-conductor-coupler shown in FIG. 6A.
Figure 6A:
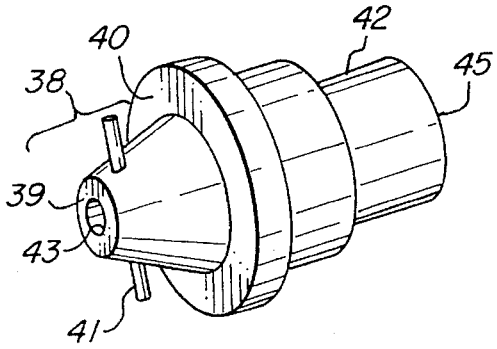
FIG. 6A, which is a perspective view of one end of an alternative embodiment of the plug-expanding-conductor-coupler.

Alternatively, the plug-expanding-surface 38 of the coupler 14 may be conically shaped and the inwardly tapering surfaces of the plug may also be conically shaped to receive the conical shaped plug expanding surface 38 as shown in FIGS. 6A and 6B. When the plug-expanding-surface 38 is conically shaped, the plug-expanding-surface 38 is provided with at least one alignment pin 39 which prevents rotation of the coupler 14 relative to the plug 12 when bolt 15 is tightened during assembly. Coupler rotation prevention is accomplished because when the coupler 14 and plug 12 are assembled together, pin 39 resides between adjacent cylindrical segments, such as, for example segments 18 and 20 shown in FIG. 6B.

Referring to FIG. 3, the connector 10 of the present invention is assembled by placing plug-expanding-surface 38 of plug-expanding-conductor-coupler 14 adjacent to inwardly tapering surfaces 46 and 48 of expandable plug 12 so that the axial bore opening 43 of the coupler 14 is substantially aligned with the axial grooves 28 and 30 in the semi-cylindrical halves 18 and 20. The threaded end 16 of bolt 15 is inserted through the axial bore 43 of coupler 14 and threaded into bore 26 in shoulder 24 of plug 12. The head 17 of bolt 15 rests on the bolt head receiving shoulder 44 within the hollow cylindrical coupling end 42. Tightening of bolt 15 causes the plug-expanding-surface 38 of coupler 14 to be drawn into the second end 32 of the plug 12, further causing the virtual diameter of the plug 12 formed by the semi-cylindrical halves 18 and 20 to be increased due to the forced separation of the halves 18 and 20 from each other.

Figure 4:
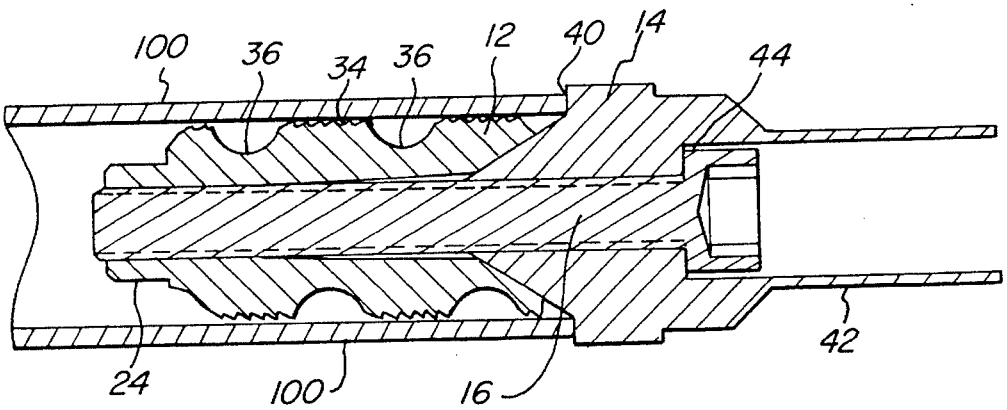
FIG. 4, which is a sectional view of the assembled connector attached to a smooth wall center conductor of an RF coaxial cable.
Figure 5:
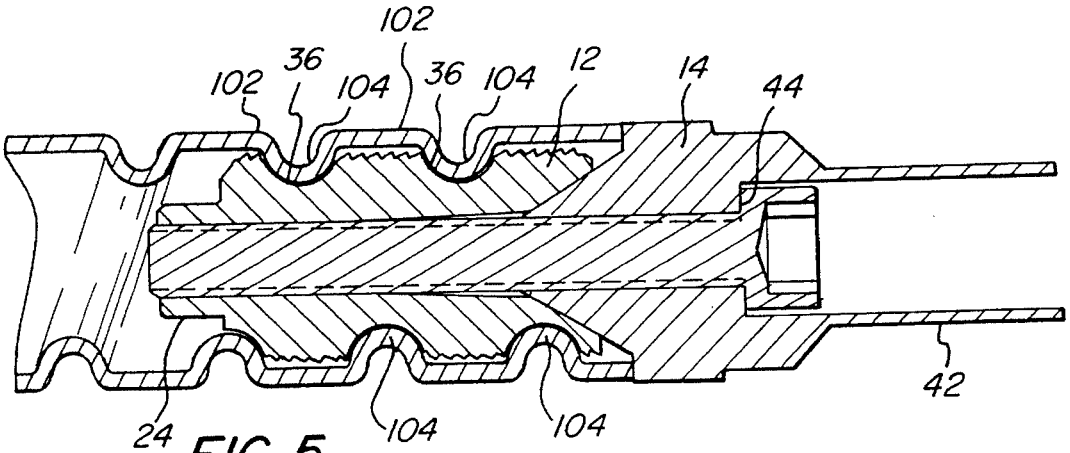
FIG. 5, which is a sectional view of the assembled connector attached to a helical corrugated center conductor of an RF coaxial cable.

Typically, loose assembly of the connector should be done prior to insertion of the plug 12 in either a smooth wall hollow center conductor or a corrugated wall center conductor. The loosely assembled plug 12 is usually inserted until the flange 40 of plug-expanding-conductor-coupler 14 is touching the end of the hollow center conductor as shown in FIGS. 4 and 5. The plug 12 is clamped in the hollow center conductor by tightening bolt 15 which cause an expansion of plug 12 by plug-expanding-surface 38 in the conductor.

Referring to FIG. 4, where it is desirable to attach the plug 12 to a smooth wall hollow center conductor 100, such attachment can be accomplished by pushing the plug 12 of a loosely assembled connector 10 into the center conductor 102. Once inserted, the plug 12 is diametrically expanded by drawing it and the coupler 14 together with bolt 15. The diametric expansion of plug 12 causes the fine threads 34 to be pressed tightly against the smooth wail of the center conductor 100. This diametric expansion of the plug 12 provides sufficient forces to be applied against the smooth wall to cause substantial resistance to the withdrawal of connector 10 from the center conductor 100 under normal use conditions.

Referring to FIG. 5, where it is desirable to attach the plug 12 to a corrugated wall hollow center conductor 102, the corrugation receiving grooves 36 of the plug 12 must be aligned with corrugations 104. This can be achieved by "threading" the plug 12 of a loosely assembled connector 10 into the conductor 102 along the corrugations 104. The expansion process for diametrically expanding the plug 12 within a corrugated wall conductor 102 so as to secure it therein is identical to that described above for plug 12 expansion in a smooth wall conductor 100.

As can be seen from the foregoing detailed description and drawings, the present invention provides a coaxial radio frequency cable center conductor connector that may be used with hollow center conductors of the smooth wall type as well as with hollow center conductors of the corrugated wall type. Although the present invention has been described with respect to one or more particular embodiments of the apparatus, it will be understood that other embodiments of the present invention may be made without departing from the spirit and scope of the present invention. Hence, the present invention is deemed limited only by the appended claims and the reasonable interpretation thereof.

What is claimed is:

1. A center conductor connector assembly (10) for use with hollow center conductors having smooth walls and for use with hollow center conductors having corrugated walls, the center conductor connector assembly comprising:

an expandable plug (12) further comprising:

a shoulder (24) having a threaded bore (26) therein, a plurality of cylindrical segments attached to the shoulder, each of the segments further including an inwardly tapering surface (46,48) at a second end (32), an outer surface (35) having means (34) for gripping a smooth wall center conductor and means (36) for receiving a helical corrugation;

a plug-expanding-conductor-coupler (14) having, at a first end (39), a means for expanding the diameter of the expandable plug when the coupler and plug are drawn together, a hollow cylindrical coupling (42) extending from a second end (45) towards the means for expanding the plug at the first end; and means (15) for drawing the plug-expanding-conductor-coupler (14) and expandable plug (12) together so as to cause a diametric expansion of the expandable plug when the means for expanding the diameter of the plug is positioned adjacent to the inwardly tapering surfaces at the second end of the expandable plug.

2. The assembly of claim 1, wherein the cylindrical segments forming the plurality are two semi-cylindrical segments.

3. The assembly of claim 1, wherein the plug-expanding-conductor-coupler (14) further includes means for preventing rotation of the plug-expanding-conductor-coupler (14) relative to the expandable plug (12).

4. The assembly of claim 3, wherein the means for preventing rotation is a pin (41) positioned on the plug-expanding-conductor-coupler (14) adjacent to its first end so as to reside in a space between cylindrical segments of the expandable plug when the plug-expanding-conductor-coupler (14) and the expandable plug (12) are assembled.

5. The assembly of claim 1, wherein the inwardly tapering surface of each segment is flat and wherein the means for expanding the diameter (38) of the expandable plug (12) at the first end of the plug-expanding-conductor-coupler (14) is wedge shaped.

6. The assembly of claim 1, wherein the inwardly tapering surface of each segment is conical and wherein the means for expanding the diameter (38) of the expandable plug (12) at the first end (39) of the plug-expanding-conductor-coupler (14) is a cone having at least one pin (41) protruding therefrom.

7. A center conductor connector assembly (10) for use with hollow center conductors having smooth walls and for use with hollow center conductors having corrugated walls, the center conductor connector assembly comprising:

an expandable plug (12) further comprising:

a shoulder (24) having a threaded bore (26) therein, a plurality of cylindrical segments (18,20) attached to the shoulder, each of the segments further including an axial groove (28,30) extending from the shoulder's threaded bore to an inwardly tapering flat surface (46,48) at a second end (32), an outer surface (35) having a plurality of teeth (34) for providing a gripping surface for a smooth wall center conductor and a helical groove (36) forming a helical corrugation receiving recess;

a plug-expanding-conductor-coupler (14) having a first end (39), an outwardly tapering flat surface (38) that tapers outwardly from the first end (39), a hollow cylindrical coupling (42) extending from a second end (45) towards the outwardly tapering surface, and an axial bore (43) extending from the first end to a bolt head receiving shoulder (44) within the hollow cylindrical coupling; and a bolt (15) for drawing the plug-expanding-conductor-coupler (14) and expandable plug (12) together so as to cause a diametric expansion of the expandable plug when the outwardly tapering surface coupler is positioned adjacent to the inwardly tapering surfaces at the second end of the expandable plug.

8. The assembly of claim 7, wherein the cylindrical segments forming the plurality are two semi-cylindrical segments.

9. A center conductor connector assembly (10) for use with hollow center conductors having smooth walls and for use with hollow center conductors having corrugated walls, the center conductor connector assembly comprising:

an expandable plug (12) further comprising:

a shoulder (24) having a threaded bore (26) therein, a plurality of cylindrical segments (18,20) attached to the shoulder, each of the segments further including an axial groove (28,30) extending from the shoulder's threaded bore to an inwardly conical surface (46,48) at a second end (32), an outer surface (35) having a plurality of teeth (34) for providing a gripping surface for a smooth wall center conductor and a helical groove (36) forming a helical corrugation receiving recess;

a plug-expanding-conductor-coupler (14) having a first end (39), an outwardly tapering conical surface (38) at the first end (39), a hollow cylindrical coupling (42) extending from a second end (45) towards the outwardly tapering surface, and an axial bore (43) extending from the first end to a bolt head receiving shoulder (44) within the hollow cylindrical coupling; and a bolt (15) for drawing the plug-expanding-conductor-coupler (14) and expandable plug (12) together so as to cause a diametric expansion of the expandable plug (12) when the outwardly conical surface of the coupler (14) is positioned adjacent to the inwardly conical surfaces of the cylindrical segments at the second end (32) of the expandable plug.

10. The assembly of claim 9, wherein the cylindrical segments forming the plurality are two semi-cylindrical segments.

11. The assembly of claim 9, wherein the plug-expanding-conductor-coupler (14) further includes means for preventing rotation of the plug-expanding-conductor-coupler (14) relative to the expandable plug (12).

12. The assembly of claim 11, wherein the means for preventing rotation is a pin (41) positioned on the outwardly tapering conical surface of the plug-expanding-conductor-coupler adjacent to its first end so as to reside in a space between cylindrical segments of the expandable plug when the plug-expanding-conductor-coupler and the expandable plug are assembled.

* * * * *